US005757288A

United States Patent [19]

Dixon et al.

[11] Patent Number: 5,757,288

[45] Date of Patent: May 26, 1998

[54] VEHICLE DETECTOR SYSTEM AND METHOD

[75] Inventors: Donald A. Dixon, Columbia, Md.; Roger Bracht, Jemez Springs, N. Mex.

[73] Assignee: Mitron Systems Corporation, Columbia, Md.

[21] Appl. No.: 643,127

[22] Filed: May 2, 1996

[51] Int. Cl.[6] ..... G08G 1/01

[52] U.S. Cl. ..... 340/941; 340/933; 340/988; 340/989; 364/436; 364/437

[58] Field of Search ..... 340/933, 941, 340/905, 436, 547, 939, 988, 989; 364/436, 437

[56] References Cited

U.S. PATENT DOCUMENTS

| | | | |
|---|---|---|---|
| 4,179,744 | 12/1979 | Lowe | 340/941 |
| 4,274,083 | 6/1981 | Tomoeda | 340/941 |
| 4,472,706 | 9/1984 | Hodge et al. | 340/941 |
| 4,529,982 | 7/1985 | Karlstrom et al. | 340/941 |
| 4,731,867 | 3/1988 | Seabury et al. | 340/941 |
| 4,912,471 | 3/1990 | Tyburski et al. | 340/941 |
| 4,996,716 | 2/1991 | Potter et al. | 340/941 |
| 5,089,815 | 2/1992 | Potter et al. | 340/941 |
| 5,198,811 | 3/1993 | Potter et al. | 340/941 |
| 5,426,363 | 6/1995 | Akagi et al. | 340/941 |
| 5,491,475 | 2/1996 | Rouse et al. | 340/941 |
| 5,493,291 | 2/1996 | Bruggemann | 340/941 |
| 5,614,894 | 3/1997 | Stanczyk | 340/941 |

*Primary Examiner*—Jeffery Hofsass
*Assistant Examiner*—Timothy Edwards, Jr.
*Attorney, Agent, or Firm*—Jim Zegeer, Esq.

[57] ABSTRACT

A vehicle detector for detecting a moving vehicle traversing a predetermined roadway includes a coil antenna for detecting electromagnetic radiation inherently generated and emitted by the vehicle as it traverses the predetermined path and producing a first signal. A low noise amplifier receives and amplifies the first signal and outputs an amplified first signal to a differential full wave amplitude modulation envelope detector and produces a second signal. A high pass filter having a predetermined cutoff frequency is connected to receive the second signal and output only third signals having a magnitude proportional to the electromagnetic signal being detected. A converter circuit converts the third signals to a digital signal, the converter circuit including a switching comparator having a source of a stable voltage reference level and outputting a fourth signal. A hysteresis detector causes the comparator to switch upon detection and thereby prevent output switching due to slower or noisy input signals, and a utilization device is connected to receive and be actuated by the fourth signal.

15 Claims, 3 Drawing Sheets

VEHICLE DETECTOR SYSTEM AND METHOD

BACKGROUND AND BRIEF SUMMARY OF THE INVENTION

Roadway vehicle detection systems using inductive sensing loops on or in a roadway are well known in the art (See Class 340 subclass 941). They operate by creating a magnetic field such that when the metal mass of a vehicle is introduced into the field caused by current flow in the loop conductors, the inductance will change, thereby changing the resonant frequency which is detected as to produce a vehicle presence signal.

Infra-red and optical have been suggested as non-contact detectors. Contact type detectors such as pneumatic tubes, pressure switches, piezoelectric and triboelectric vehicle detectors are actuated by weight or pressure of vehicle wheels traversing the sensor. A utilization device such as a counter or traffic control system is connected to the sensing device It has been found that almost all vehicles radiate a fairly significant amount of electrical energy in the form of electromagnetic energy as they are operating. This energy is mostly concentrated between 3 kilohertz (kHz) and 200 kHz in frequency.

The vehicle Detector system and method of this invention detects the presence of a vehicle passing over or near it by detection of electromagnetic energy emanating from the vehicle when it is in operation. The sensor filters the signal to minimize false alarms. In a preferred embodiment just one pulse per vehicle is outputted from the detector. The system operates at low currents (less than 10 milliamps of current) and voltage (9 volts DC). This voltage requirement can easily be modified to operate at other voltages as needed. It has also been designed for minimal components so that it can be built small, rugged and reliable.

The object of this invention is to provide an improved vehicle detection system that does not require physical contact with the vehicle being sensed. Another object of this invention is to provide an improved vehicle detection system and method which is based on the detection of electromagnetic radiation emitted by vehicles when in operation. Another object of this invention is to provide a vehicle detection system which operates at low voltages, is low in cost, small, reliable, has a low or thin profile.

Various experiments have been performed and it has been found that almost all vehicles emit or radiate a fairly significant amount of electrical energy as they are operating. This energy is mostly concentrated between 3 kilohertz (kHz) and 200 kHz in frequency. With this in mind, the detector, in one of its preferred embodiments, is mounted on the roadway or in a shallow recess in the roadway, picks up energy with a coil of wire type of antenna as the vehicle traverses the roadway. The signal is amplified, preferably through two stages of low noise amplification. It is then detected with an amplitude modulation envelope detector using low offset schottky diodes. The output signal is filtered and converted to digital signal by comparing it with a stable voltage reference level. This output is also filtered and applied to a hysteresis detector which causes the comparator to switch upon detection and thereby prevent output switching due to slower or noisy input signals. The output is then converted to a transistor logic (TTL) compatible signal. The coil antenna and electronic circuit can be in the same or separate housings or an umbilical or wireless communications can send signals from the coil antenna to a base station at the side of the road. The antenna can be installed on top of the road or buried in a cavity in the road. The antenna detects radiation under various types of road epoxy, asphalt or concrete. However, the thickness and metal content of the covering material can affect the sensitivity of the antenna.

DESCRIPTION OF THE DRAWINGS

The above and other objects advantages and features of the invention will become clearer when considered in light of the following specifications and accompanying drawings, wherein.

DETAILED DESCRIPTION OF THE INVENTION

Figure 4:
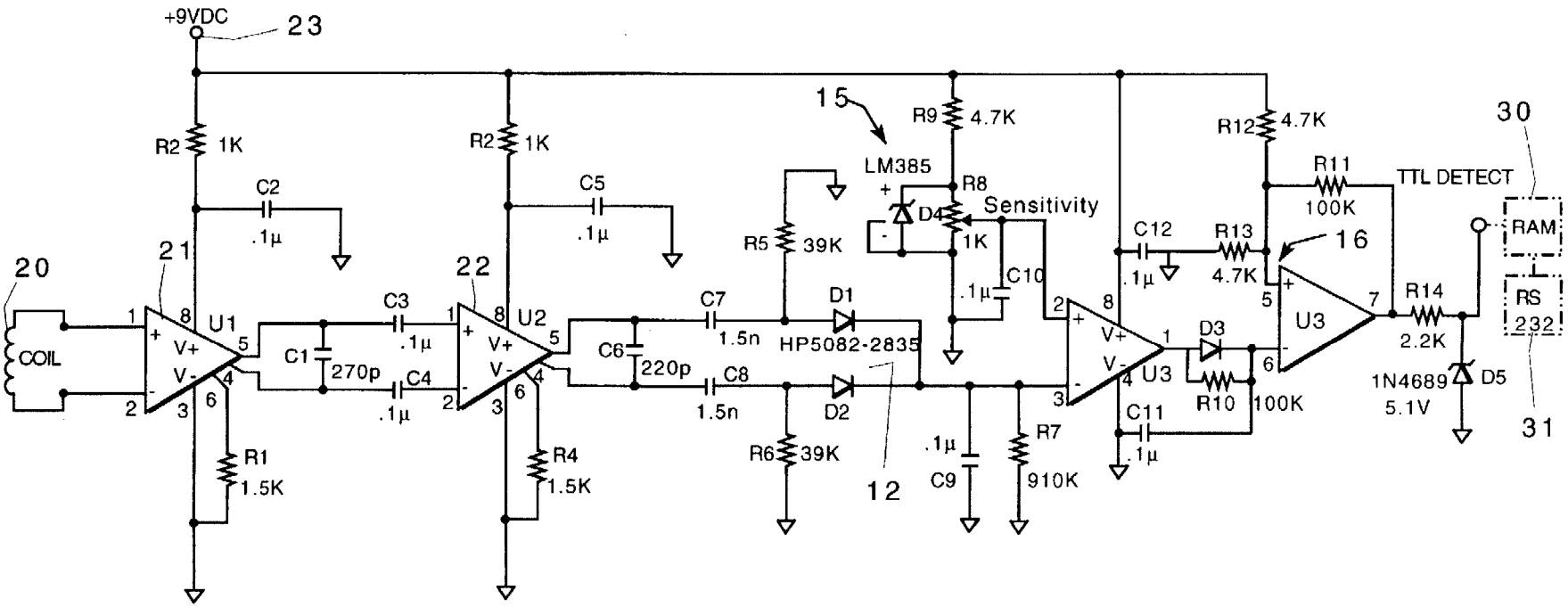
FIG. 4 is a detailed illustration of the circuit incorporating preferred embodiments of the invention.

A multilane roadway or highway MLH has lanes L1, L2 . . . LN each of which may be provided with a vehicle detector VD1, VD2 . . . VDN of this invention. As diagrammatically indicated, the vehicles V in each lane emit electromagnetic radiation concentrated mostly between about 3 kilohertz (kHz) and about 200 kHz in frequency. Each vehicle detector is separate and vehicle presence signals may be coupled to a utilization device ud such as a traffic counter, recorder etc. by coaxial cable cc or a low powered radio transmitter rt, or down loaded to a processor via an RS-232 port, each vehicle detector having its own unique identification number or code. In one preferred embodiment, the sensing antenna for each detector is a thin flat coil tfc which has a low profile so that it can be contained in a flat low profile package 1 pp which is mounted on the roadway and preferably in the center of the lane. For multilane roadways this assures that emissions from vehicles traveling in lane L1 are below the detection level of the detector in the other lanes and vice versa. The detector as disclosed in FIG. 4 will reliably detect radiations from within about one to two feet away from the antenna coil. It will be appreciated that the coil antenna can be placed on or embedded in the roadway and signals induced in the coil connected by coaxial cable or other umbilical or wireless communication to a base station circuitry at the side of the roadway.

Figure 2:
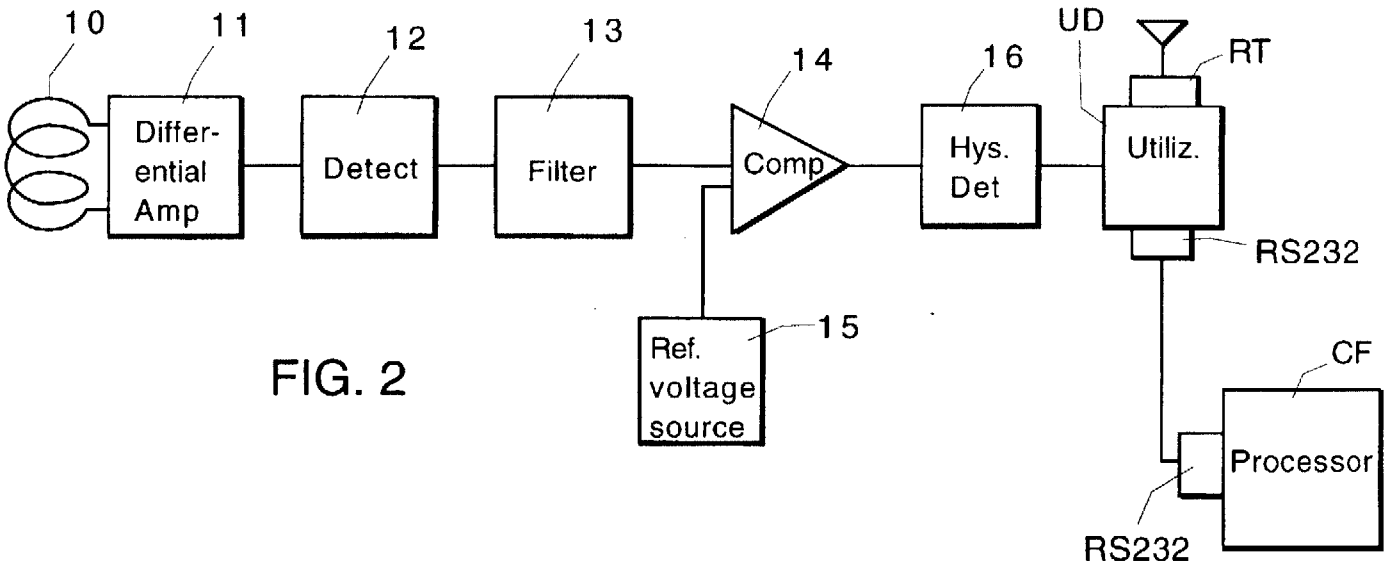
FIG. 2 is a block diagram illustrating a separate detector for each lane of the roadway illustrated in FIG. 1.

Referring to the block diagram in FIG. 2, the detector, in one of its preferred embodiments, picks up emitted electromagnetic energy with a coil of wire type of antenna 10. The signal is amplified through two stages of low noise amplification 11. This amplified signal is then detected with an amplitude modulation envelope detector 12 using low offset schottky diodes. The detector output signal is filtered 13 and converted to digital signal by comparing in comparator 14 it with a stable voltage reference level from source 15. This output is also filtered and applied to a hysteresis detector 16 which causes the comparator 14 to switch upon detection and thereby prevent output switching due to slower or noisy input signals. The output is then converted to a transistor logic (TTL) compatible signal and outputted to a utilization device UD.

The detector can be mounted in a recess cut in the roadway with a groove for a coaxial cable (cc lane LN) or an RS-232 type cable leading to the side of the roadway to a counter or other utilization device. Alternatively, the detector can be temporarily secured to the roadway by an adhesive, or nailing. In such case the output signals is to a downloadable RAM via an RS-232 port (lane L1). The detectors in this case are gathered up or removed from the roadways and the stored data is outputted or downloaded to a computer for further processing. The identity of the device, its roadway location, time(s) of operation, etc. can be outputted at that time. As a further alternative, the detectors can be provided with a radio transmitter RT which downloads data stored in the RAM and broadcasts the data to a receiver (shown for example on the utilization device UD in FIG. 1) when polled. Vehicle tires running over the unit does not affect the ability to detect the vehicle. When the coil antenna is positioned at a 90° angle to the road it will detect vehicles.

Pickup Coil

Pickup coil 10' (FIG. 4) acts as an antenna for the detector. Since the wavelengths of the signal being detected are very long compared to the detector, a multiple turn coil works well as an antenna. With the wavelengths of the signal being long, there is very little phase cancellation between turns of the coil. In other words, all turns of the coil tend to pick up the same phase of the signal being detected. Each turn of the coil acts like a small voltage source that adds the signal to that being detected by other turns, thus increasing the sensitivity of signal detection. However, there is a limit to the practical size of the coil. Also, there is a limit due to the increased inductance which reduces the frequency response of the system.

Signal Amplification

Signal Amplification is performed by two stages of amplification 21 and 22. The amplifier components used are Signetics RE602 devices (U1 and U2). These parts are listed in the data book as double balanced mixer and oscillators. It has been found that by disabling the oscillator part of the component, that they can be used as very low noise, low power, differential amplifiers. Differential amplification is desirable to minimize noise and the ease of interfacing to the coil without a ground reference. These amplifiers are also internally biased at the input so that no extra biasing circuitry is needed to use them. Amplifier 21 (U–1) is used as the first stage preamplifier. The coil 10' directly connects to the input of the amplifier terminals 1 and 2. Power Is supplied from the +9 volt source 23 through R2, a one kilohm (Kohm) resistor. The typical current drain of the NE602 is 2.4 ma. Thus the operating voltage at the device, through the I Kohm resistor, is approximately 6.6 volts. This will vary some with variations in operating current and supply voltage. This variation is OK since the device will operate fine from 4.5 volts to 8 volts at its power supply input. Other operating voltages can be used by adjusting these input power supply resistors as needed. The signal is decoupled by a 0.1 micro farad (uf) capacitor C2. This helps to further reduce any signal component or other noise that may be on the power supply line. Also it reduces amplifier induced current variations from getting back into other parts of the circuit. This power supply filter acts as a low pass filter with a 3 decibel (dB) cutoff at 1.6 kHz. R1 (1.5 kohm) is connected from pin 6 to ground to insure that the internal oscillator is disabled. This allows the device to be used as a very low noise, high gain differential amplifier. The gain of the NE602 used in this configuration is about 20 in magnitude. C (270 p) is an output filter capacitor that reduces the upper end of the detection spectrum to about 200 kHz. it is desirable to keep the bandwidth as small as possible to reduce noise pickup, etc.

Preamplifier 21 is coupled to the next stage 22 of amplification by two 0.1 uf capacitors C3, C4. The input impedance of the NE602 is 1.5 Kohm. Thus, this coupling acts as a high pass filter with a cutoff frequency of about 1 kHz. Amplifier 22 (U2) is connected to the power supply as described above for amplifier 21 (U1). The sample decoupling scheme is used through R3 and C5. Also R4 is used to disable the internal oscillator. This stage also has a gain of about 20. A third NE602 could be used after this one if even more gain and sensitivity is desired in the detector. A 220 p capacitor C6 is used on the output to continue the bandwidth limiting begun with the preamplifier. This filter lowpass corner is at 240 kHz.

AM Detector

The amplitude modulation detector 12 is designed as a differential full wave envelope detector that consists of passive components only, and thus reducing power drain in the system. The output of the amplification stage is AC coupled through two 0.00I5 uf capacitors (C7 and CB) into R5 and R6 and diodes DI and D2. These diodes are 5082-2835 schottky diodes made by HP. Each capacitor and resistor form a high pass filter with a cutoff at 2.7 kHz. This helps to minimize spurious lower Frequency energy from affecting the signal detection. Diodes DI and D2 are schottky detector diodes that are used because of their very low forward voltage drop. This increases the sensitivity of the system since less signal drop has to be overcome by the signal amplification. The diodes act like signal rectifiers and in conjunction with the capacitor C9 produce the peak amplitude of the signal being detected. Using two diodes on a differential signal like this produces full wave rectification of the signal. In other words, there are two peaks detected for every cycle of the signal being processed. Thus, the carrier of the signal is removed and a lower frequency component is produced that is proportional to the magnitude of the signal being detected. When the detected signal goes away, the signal produced on capacitor C9 will decay back towards ground level. This decay is exponential through R7. The time constant is about 0.1 seconds. Thus, the signal will almost fully decay, with no other input, in about 0.5 second.

Voltage Reference

To allow for a stable level to compare to for signal discrimination, a stable voltage reference 15 is needed. This reference produces the level that will be used to compare the output of the AM detector to provide determination whether or not it is a valid signal. A National Semiconductor LM385 (D4) voltage reference is used for this part of the circuit. The current drain is 1.6 ma. as biased through R9. The reference voltage generated at the cathode of D4 is 1.2 volts and specified to be stable to within plus or minus 20 parts per million. A 1 Kohm potentiometer is placed across this reference to allow adjustment of the detector sensitivity as needed. Once the appropriate resistor setting is determined, this component can be replaced by two resistors of the appropriate value for the sensitivity needed.

Digital Detection

The signal is then processed by the use of on opamp U3. This opamp is a Texas Instruments TLC27M2. This part is used here as a couple of comparators in conjunction with some passive components to filter and convert the signal to a TTL level. The TLC27M2 was chosen because it operates on very low current, has latch up immunity, operates on a single supply, and has a high input impedance. It is also small in size as there are two active parts (a,b) in one 8 pin dip.

The first comparator (U3*a*) simply compares the level of the output of the AM detector with the sensitivity reference level from R8. If the signal from the AM detector is higher, the output at pin one goes high and rapidly charges a 1 uF capacitor (C11). This acts as a filter also since it requires about a millisecond to charge the capacitor to the detection level of the next stage due to the output current limit of the opamp. When the signal goes away, the capacitor is discharged through a 100 Kohm resistor (R10). This time constant is 0.1 second. Thus the output signal is stretched a second time on the discharge side of the signal to minimize multiple detects on a passing vehicle.

The signal is then passed through a hysteresis comparator or detector 16 consisting of U3*b* and R11, R12, and R13. The reference level at pin 5 (+input) is biased at about 4.5 volts. This level is reduced or increased by 0.1 volt depending on whether the output is at a high or low level. This small amount of positive hysteresis causes the comparator to switch upon detection and prevents multiple output switching due to slower or noisy input signals on the negative input (pin 6).

Figure 1:
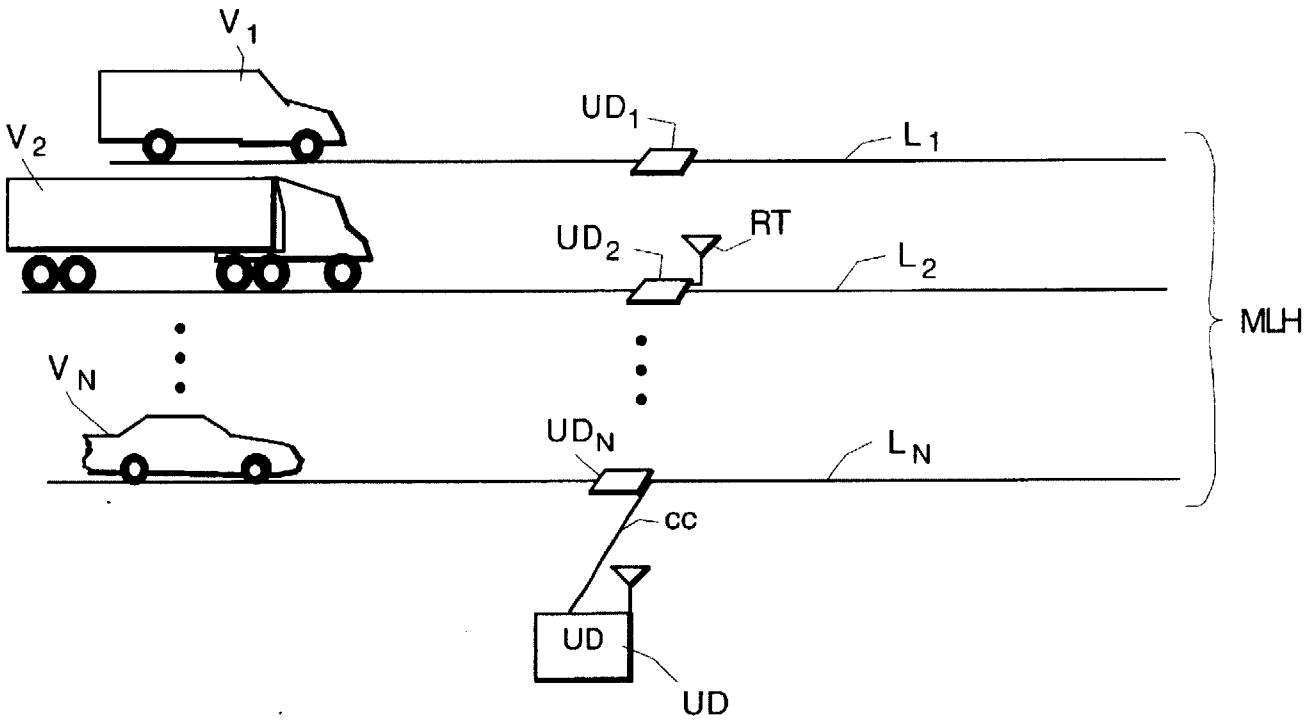
FIG. 1 is a diagrammatic illustration of the invention as applied to a multilane roadway or highway.
Figure 3:
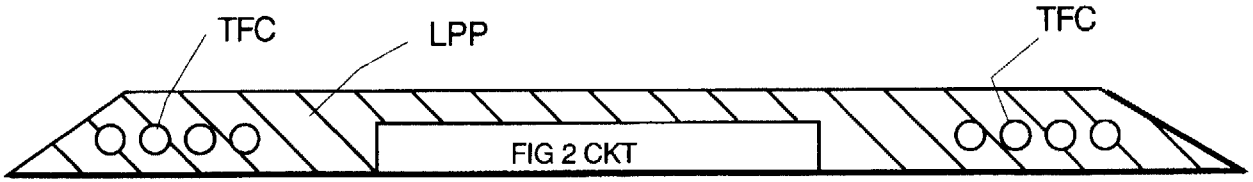
FIG. 3 is a sectional view of an on pavement detector incorporating the invention.

The output signal is then converted to a TTL type signal by passing it through a 2.2 Kohm resistor connected to a 5.1 volt zener diode D5. This will typically drive one LS (low power schottky) TTL load. Other conversion schemes could be used as the output of U3*b* is typically From near 8 volts to near ground in signal level. A low level signal is the detect level and means that the circuit has detected the appropriate signal in its bandwidth range. The TTL vehicle presence signals can be stored in a RAM 30, and down loaded via an Rs-232 port 31 to a processor at a central facility CF, or at the side of the roadway as indicated in FIG. 1.

Another use of this product is to place two units or antennas in the same lane a certain distance apart in the center of the lane. The length of separation could be a few inches to a few feet, depending upon how much one unit or antenna would interfere with the operation of the other. By knowing the distance between the units or antennas and time stamping the inputs from each, it would be easy to calculate, record, and display the speed of the vehicle. If the distance of separation warrants, the units or antennas could be placed in the same housing.

While the invention has been described with respect to several preferred embodiments of the invention it will be appreciated that various modifications and adaptations of the invention will be readily apparent to those skilled in the art.

What is claimed is:

1. A method of detecting a moving vehicle traversing a predetermined point on a roadway, comprising:

positioning a coil antenna at said predetermined point for detecting electromagnetic radiation generated by operation of said vehicle and emitted by said vehicle as it traverses said predetermined point and producing a first signal, receiving and amplifying said first signal and outputting an amplified first signal, providing a detector for receiving said amplified first signal and detecting pulses caused only by operation of said moving vehicle and producing a digital signal corresponding thereto.

2. System for detecting a moving vehicle traversing a predetermined point on a roadway, comprising:

coil antenna means adapted to be positioned at said predetermined point for detecting electromagnetic radiation generated by operation of said vehicle and emitted by said vehicle as it traverses said predetermined point and producing a first signal, amplifier means for receiving and amplifying said first signal and outputting an amplified first signal, detector means for receiving said amplified first signal and detecting pulses caused only by operation of said moving vehicle and producing a signal corresponding thereto, and a utilization device connected to receive said digital signal.

3. A vehicle detector for detecting a moving vehicle traversing a predetermined path, including a roadway, comprising:

antenna means for detecting electromagnetic radiation generated by operation of said vehicle and emitted by said vehicle as it traverses said predetermined path and producing a first signal, low noise amplification means for receiving and amplifying said first signal and outputting an amplified first signal, differential full wave amplitude modulation envelope detector means connected to receive said amplified first signal and producing a second signal, high pass filter means having a predetermined cutoff frequency connected to receive said second signal and output only third signals having a magnitude proportional to the electromagnetic signal being detected, converter circuit for converting said third signals to a digital signal, said converter circuit including a switching comparator having a source of a stable voltage reference level and outputting a fourth signal, hysteresis detector means for causing said comparator to switch upon detection and thereby prevent output switching due to slower or noisy input signals, and a utilization device connected to receive and be actuated by said fourth signal.

4. The vehicle detector defined in claim 3 wherein said predetermined cutoff frequency is about 2.7 kHz.

5. The vehicle detector defined in claim 3 wherein said amplification means is comprised of differential amplifier means and said coil antenna having two ends and means connecting said two ends to said differential amplifier means.

6. The vehicle detector defined in claim 3 wherein said envelop detector is composed of passive components.

7. The vehicle detector define in claim 6 wherein said passive components include schottky diodes.

8. The vehicle detector system defined in claim 3 wherein said antenna means is constituted by multiple turns of a coil of wire.

9. The vehicle detector system defined in claim 8 wherein said coil of wire is flat and includes means for mounting said coil of wire proximate the center of a roadway lane.

10. The vehicle detector system defined in claim 9 including means to couple a vehicle presence signal to said utilization device.

11. The vehicle detector defined in claim 3 including means in said comparator circuit for minimizing multiple detects on a passing vehicle.

12. The vehicle detector defined in claim 11 wherein said means for minimizing multiple detects on a passing vehicle includes means for stretching said fourth signal.

13. The vehicle detector defined in claim 12 wherein said means for stretching said fourth signal includes a time constant circuit.

14. A vehicle detector system for a vehicle having electromagnetic radiation in the range of 3 khz to 200 khz, comprising, A. a coil antenna having first and second ends, B. a low noise differential amplifier (LNDA) having first and second input terminals connected to said first and second ends, respectively, and an LNDA output terminal, C. a differential full wave envelope detector connected to said LNDA output terminal, D. an operational amplifier having 1) a signal input connected to said envelope detector and 2) a reference voltage input terminal, a source of reference voltage connected to said reference voltage input terminal, E. a hysterisis comparator connected to said operational amplifier for preventing output switching due to slow or noisy input signals, and F. a utilization device connected to said hysterisis comparator circuit.

15. A method of detecting a moving vehicle traversing a predetermined point on a roadway, comprising:

positioning a coil antenna at said predetermined point for detecting electromagnetic radiation generated by operation of said vehicle and emitted by said vehicle as it traverses said predetermined point and producing a first signal, providing a low noise amplification means for receiving and amplifying said first signal and outputting an amplified first signal, differential full wave amplitude modulation envelope detecting said amplified first signal and producing a second signal, high pass filtering said second signal and produce a third signal having a magnitude proportional to the electromagnetic signal being detected, converting said third signal to a digital signal, including comparing said third signal to a stable reference voltage level and outputting a fourth signal, preventing output switching of said fourth signal due to slower or noisy input signals, and supplying said fourth signal to a utilization device.

* * * * *

UNITED STATES PATENT AND TRADEMARK OFFICE
Certificate

Patent No. 5,757,288 Patented: May 26, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Roger Bracht, Jemez Springs, N. Mex.; and Robert M. Tyburski, Lottaburg, Va.

Donald A. Dixon is to be deleted as co-inventor of identified patent.

Signed and Sealed this Eleventh Day of May, 1999.

MICHAEL HORABIK, SPE
*Supervisory Patent Examiner*
Art Unit 2735